US007263792B2

(12) United States Patent
Slowski

(10) Patent No.: US 7,263,792 B2
(45) Date of Patent: Sep. 4, 2007

(54) ILLUMINATED IDENTIFICATION PANEL

(76) Inventor: Darrel Robert Slowski, 7796 Highway #9 RR#1, Schomberg, Ontario (CA) L0G 1T0

( * ) Notice: Subject to any disclaimer, the term of this patent is extended or adjusted under 35 U.S.C. 154(b) by 65 days.

(21) Appl. No.: 10/729,927

(22) Filed: Dec. 9, 2003

(65) Prior Publication Data

US 2005/0120604 A1 Jun. 9, 2005

(51) Int. Cl.
*G09F 13/22* (2006.01)

(52) U.S. Cl. ..... 40/544; 40/564

(58) Field of Classification Search ..... 40/544, 40/580, 542, 578, 564; 315/169.3, 169.4
See application file for complete search history.

(56) References Cited

U.S. PATENT DOCUMENTS

| | | | | | |
|---|---|---|---|---|---|
| 3,188,761 | A | * | 6/1965 | Harrold | 40/544 |
| 3,404,474 | A | * | 10/1968 | Johnson | 40/544 |
| 3,680,237 | A | * | 8/1972 | Finnerty, Sr. | 40/544 |
| 3,680,238 | A | * | 8/1972 | Arnold | 40/564 |
| 4,016,450 | A | * | 4/1977 | Balekjian | 315/149 |
| 4,272,901 | A | * | 6/1981 | Matthews | 40/574 |
| 4,327,511 | A | * | 5/1982 | Rodriquez | 40/544 |
| 4,466,208 | A | * | 8/1984 | Logan et al. | 40/544 |
| 4,841,155 | A | * | 6/1989 | Ushida et al. | 250/463.1 |
| 4,903,172 | A | * | 2/1990 | Schoniger et al. | 362/612 |
| 4,937,499 | A | * | 6/1990 | Hunte | 315/149 |
| 4,989,956 | A | * | 2/1991 | Wu et al. | 349/71 |
| 5,153,760 | A | * | 10/1992 | Ahmed | 349/116 |
| 5,315,491 | A | * | 5/1994 | Spencer et al. | 362/84 |
| 5,485,145 | A | * | 1/1996 | Sniff | 340/815.4 |
| 5,516,387 | A | * | 5/1996 | Hoffman | 156/70 |
| 5,646,481 | A | * | 7/1997 | Zovko | 313/510 |
| 5,698,301 | A | * | 12/1997 | Yonetani | 428/213 |
| 5,709,045 | A | * | 1/1998 | Thelen | 40/544 |
| 5,759,671 | A | * | 6/1998 | Tanaka et al. | 428/166 |
| 6,188,175 | B1 | * | 2/2001 | May et al. | 313/504 |
| 6,240,664 | B1 | * | 6/2001 | Hjaltason | 40/546 |
| 6,367,180 | B2 | * | 4/2002 | Weiss et al. | 40/580 |
| 6,612,055 | B2 | * | 9/2003 | Bradford | 40/546 |
| 6,745,507 | B2 | * | 6/2004 | Golding | 40/564 |

FOREIGN PATENT DOCUMENTS

| | | | |
|---|---|---|---|
| GB | 2034503 | A * | 6/1980 |
| GB | 2220097 | A * | 12/1989 |

* cited by examiner

*Primary Examiner*—Gary C. Hoge
(74) *Attorney, Agent, or Firm*—Eugene J. A. Gierczak

(57) ABSTRACT

A long-range house number identification panel has its number indicia mounted on an illuminated viewing screen, being individually readable with the naked eye from up to 200 feet distance. An electrically energizable phosphorescent screen behind the indicia serves to illuminate the numbers at night. The identifying indicia may consist of transparencies through the surface of a blanking screen. A photocell switches off the screen in daylight; and the level of screen illumination may be limited below the optimum, by operating at a reduced voltage so as to extend the service life of the screen. A u/v barrier coat may be used to protect the phosphor of the screen against solar degradation.

17 Claims, 1 Drawing Sheet

ILLUMINATED IDENTIFICATION PANEL

CROSS REFERENCE TO RELATED APPLICATIONS

Not Applicable

Statement Regarding Federally Sponsored Research or Development

Not Applicable

REFERENCE TO MICROFICHE APPENDIX

Not Applicable

BACKGROUND OF THE INVENTION

1. This invention is directed to a back-lighted phosphorescent panel for silhouetting identification indicia, such as house numbers, and in particular to a panel having long range visibility, for remote viewing.

2. There are products presently available in the market for use with house address numbers, wherein a planar panel is backlighted by phosphor-based luminescence, to silhouette dark numbers which block off selected areas of the lighted surface.

These prior art products are characterized by a number of disadvantageous aspects:

1) the panels are limited in size, usually to rectangles about 3-inches by 5-inches;
2) many of the panels are permanently energized, being connected to the door-bell power circuit, thereby reducing the working life of the panel;
3) the panels are subject to ultra-violet degradation, becoming bleached by sunlight.

The small, three inch by five inch size of existing panels defeats a major safety potential of such signage, which is the rapid identification of a property address by distant-viewing from a remote vantage point in the adjacent street at times of crisis and extreme emergency.

At the present time, when an emergency alarm is generated for a service such as the Fire Service, in answer to a domestic call involving a fire or a heart attack, it is frequently necessary for a pilot, spotter vehicle to precede the response team, in order to locate the given address of the premises where the crisis has originated. In such instances, the currently available above-mentioned illuminated signage is generally completely indecipherable from the street, owing to its undue size limitation, rendering it virtually useless at a time when it is most needed. The delay presently associated with this circumstance may prove in some instances to be fatally critical.

BRIEF SUMMARY OF THE INVENTION

The present invention provides an illuminated signage consisting of weatherproof, wall-mountable display having a frame enclosing a planar, backlighted screen. In one embodiment the screen is some 4¾ inches by 9¼ inches, suitable for use with characters as large as four inches high, such as four such numbers, which are mounted upon the face of the screen, in obscuring relation with predetermined areas of the screen, so that the characters appear in silhouette, with a lighted background. Customized graphics may also be used with the panel.

The "lamp" (i.e. the lighted area of the screen) can be rectangular, ovoid or other selected shape, in accordance with the shape of the screen housing, which is usually a plastic moulding.

In the dark, signs in accordance with the invention are readable from some two hundred feet away.

A preferred embodiment of the present invention has a u/v protective coating applied to the face of the screen, to limit or preclude damage from the sun.

A further characteristic of the subject invention is the use of a photocell, to de-energise the screen when a predetermined level of local illumination, such as daylight occurs. This de-energizing is achieved by interrupting the low voltage D.C. circuit of the photoluminescent screen. The result of interrupting the energization of the screen is to terminate its light emission, and to correspondingly extend the life expectancy of the screen.

A further characteristic of the present invention is the operation of the screen at a reduced voltage such that the level of luminescence is reduced to an acceptable degree without unduly compromising visibility, while correspondingly extending the life expectancy of the phosphor.

As a consequence of the foregoing innovations, the subject invention provides a unitary photo-luminescent signage of sufficient area to illuminate a plurality of four-inch high symbols, possessing u/v protection of the screen face, and operating at a reduced voltage, less than the permissible optimum, and possessing anticipated extended life expectancy.

The screen has a light-toned colour, so that in daylight conditions when the screen is not energized, the dark-coloured indicia are clearly visible, in contrast against the light-toned screen.

The indicia may be protected against the elements and unauthorized tampering by a clear protective mask. This mask may incorporate the u/v protective layer.

As an alternative arrangement to the use of superimposed indicia, an opaque mask may be used, having the indicia or other visual display matter as clear surface areas of the mask, so that the revealed illuminated surface of the screen will be in the form of the desired indicia or display.

The term "opaque indicia means" is intended to encompass both the superimposed opaque individual indicia and the opaque mask having indicia as unobstructed screen areas.

The subject signage may be powered by household power, through a step-down transformer, by a solar cell, or alternative electrical sources.

BRIEF DESCRIPTION OF THE SEVERAL VIEWS OF THE DRAWINGS

Certain embodiments of the invention are described by way of illustration, without limitation thereto other than as set forth in the accompanying claims, reference being made to the accompanying drawings, wherein:

DETAILED DESCRIPTION OF THE INVENTION

Figure 1:
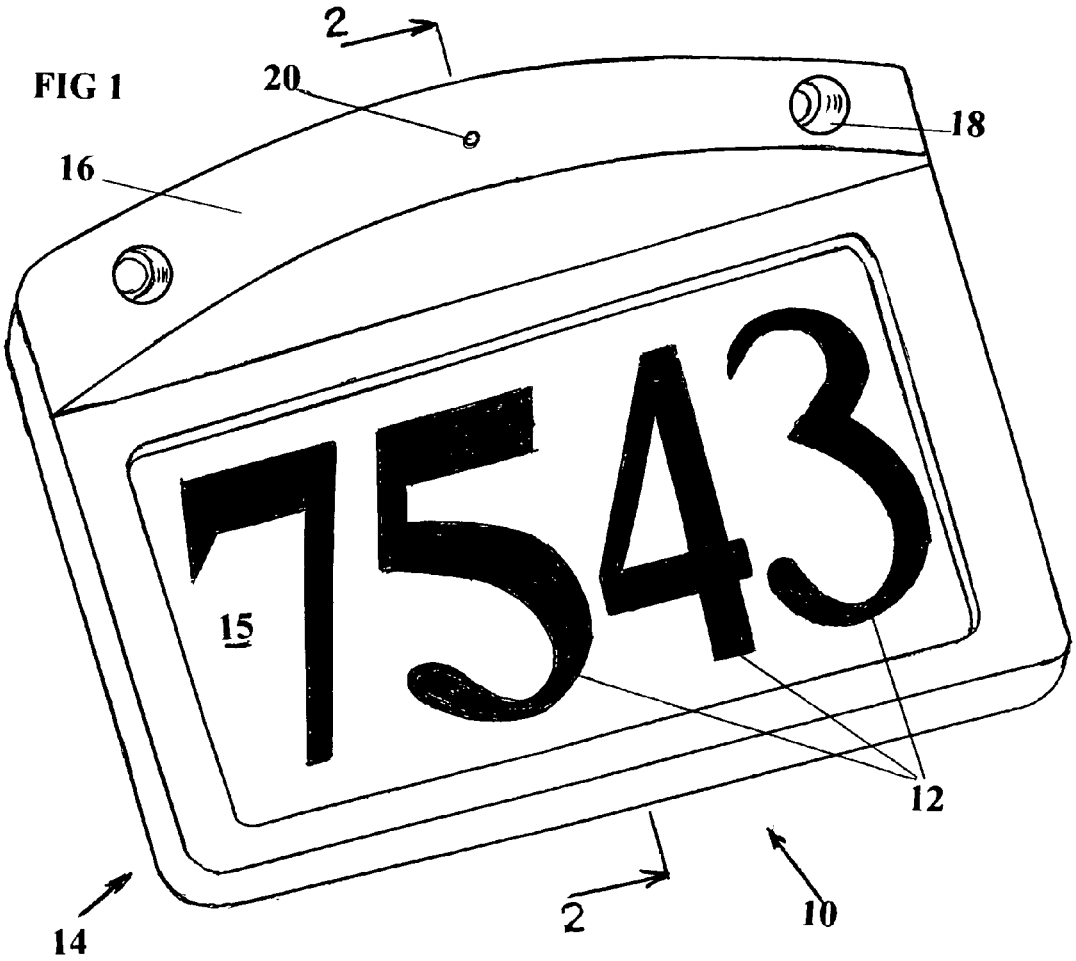
FIG. 1 is a perspective front view of a domestic embodiment of the subject illuminated identification panel; and, FIG. 2 is a schematic section view of the subject panel, illustrating certain of its characteristics.

Referring to FIG. 1, a photo-luminescent panel 10 in accordance with the present invention is of a size to show a plurality of four-inch indicia 12, indicated herein as four Arabic numerals, 7, 5, 4, 3, 2 indicative of a Street address number.

The illuminated screen 15 has an exposed area of 4¾ inches by 9¼ inches, to provide good light profiling of up to four 4-inch, substantially opaque numbers, with adequate illuminated surround for easy distant viewing. In the case of a "negative" display (as in 'photographic negative'), wherein the characters appear as lighted screen surface, with adjoining surface areas being blanked off, the characters can be yet larger, and extend to the screen edges.

A raised bridge portion 16 of the housing 14 has a pair of screw recesses 18 into which support screws (not shown) are inserted, for mounting the panel on a vertical support surface.

Figure 2:
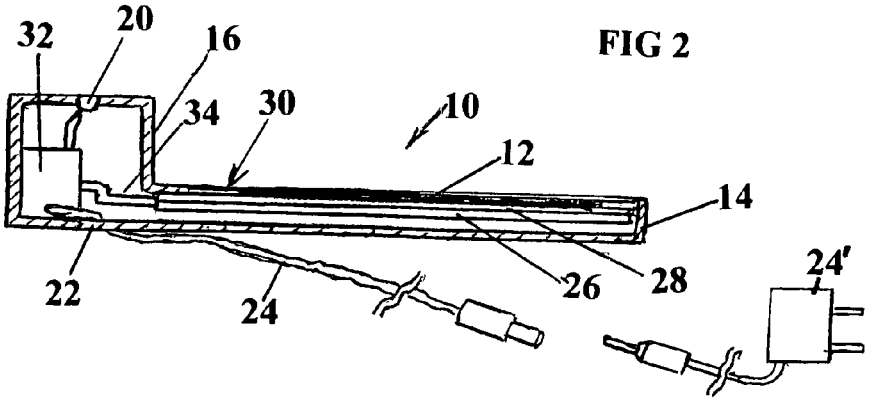

A photo cell 20 is mounted centrally within the bridge portion 16. Referring to FIG. 2, the panel 10 has a removable back cover 22 through which is connected a power cord 24.

Within the housing 14 is a copper backing 26 and phosphor coating 28 which serves as the light emitter 30, being connected to an external power source, as represented by the connecting cord 24. Power may be by way of a transformer/rectifier 24' connected with a domestic house circuit, or by connection to a bell-circuit, or a solar cell, neither of which are shown.

The photo cell 20 is connected in controlling relation with the 'on/off' switching relay 32 to control the series connection between the external power supply as represented by the power connection 24 and the light emitter 30, so as to open-circuit the connection 34 during daylight hours, and to close, and energize emitter 30 when ambient light dims to a pre-set threshold level. Thus, when daylight diminishes and the photo cell 20 operates, this permits the emitter 30 to become energized, and the panel 10 becomes illuminated, thereby back-lighting the indicia 12, or lighting the perforations of a 'negative' screen.

One such 'negative' indicia screen may comprise a clear plastic having the desired indicia areas unobstructed, and the remainder of its surface blanked off. This particular arrangement then permits the use of the full screen dimensions, such that, in the instance of the embodiment herein described, indicia may extend to the edges of the screen, i.e. up to 4¾ inches high; giving an 18% increase in effective indicia dimension, compared to four inch indicia numbers. By use of a dark paint as the blanking medium, the "blonde" surface of the screen shows through in contrast, in daylight conditions when the screen is not energized.

It is contemplated that a specialty installation might comprise a "negative" screen in which the blanking medium (probably a paint) might be precisely the same colour as the colour of the non-illuminated screen. In this case, the screen would be an apparent blank under non-illuminated conditions, and the indicia would only be viewable when the screen is energized.

This type of identification panel might be used within a secured, enclosed establishment, wherein access to restricted areas is obstructed, by an absence of room or zone identification, which can be instantly overcome by operation of the energizing circuit for the identifying sign of the selected zone.

The invention claimed is:

1. A house number identification panel, having a plurality of number indicia in selected arrangement positioned externally upon a viewing screen, a single electrically energizable phosphorescent screen having a rated operating voltage to provide a first level of luminescence of said screen, located behind said indicia; electrical supply means to energize said single phosphorescent screen to provide to said screen a voltage less than said rated operating voltage, to provide an acceptable lower level of luminescence, below said first level of luminescence and switch means responsive to a predetermined ambient light condition, connected in controlling relation with said electrical supply means, to disconnect said electrical supply from said screen and enable operation of said panel in an electrically unenergized condition under said predetermined ambient light condition; a framing border surrounding the identification panel comprising two spaced side members, a bottom member and a top member, wherein the top member protrudes outwardly beyond said bottom and side members.

2. The identification panel as set forth in claim 1, wherein said top member includes a recess for housing said electrical supply means.

3. The identification panel as set forth in claim 2 having a lateral width to accommodate four of said indicia.

4. The identification panel as set forth in claim 1, wherein said indicia are selected from the group consisting of separate, individual indicia of opaque material, and an opaque sheet having apertures therethrough shaped in the form of said indicia to permit the passage of light from said screen when energized.

5. A luminescent display for use in illuminating identification indicia, including a housing for attachment to a support surface; a single phosphorescent screen having a viewable area, substantially opaque indicia means mounted externally upon said luminescent display; and electrical energizing means connected to the screen to apply a predetermined voltage to the screen in energizing relation therewith to illuminate the single phosphorescent screen to view the indicia when the screen is energized, said predetermined voltage being at a value significantly less than the rated value of said single phosphorescent screen, to correspondingly extend the service life expectancy for the screen; said housing defining along one surface a framing border having two spaced side members, a lower member and an upper member, wherein the upper member extends outward from the surface beyond the lower and side members.

6. The luminescent screen as set forth in claim 5, including light-responsive cut-out means disposed on said upper member to disconnect said energizing means from said screen when ambient light exceeds a predetermined threshold level, to thereby significantly reduce the time of energization of said screen and to correspondingly increase the life expectancy of the screen.

7. The luminescent screen as set forth in claim 5, wherein said phosphorescent screen has a light-toned colour, and said opaque indicia means are dark coloured, to provide a readily visible contrast under external illumination, to facilitate viewing from a distance.

8. The luminescent screen as set forth in claim 5, said upper member includes a recess, said energizing means disposed in said recess.

9. An illuminated sign comprising:

(a) a housing having a surface defining a top bottom, two spaced sides and a display opening;

(b) a single phosphorescent panel disposed within said housing, said phosphorescent panel defining a screen adjacent said display opening;

(c) an ultraviolet filter layer disposed over said screen;

(d) indicia associated with said screen;

(e) electrical circuitry for energizing said phosphorescent panel to visually illuminate said screen for viewing said indicia;

(f) a light sensor to activate said reduced electrical power means at a selected level of light condition;

(g) said ton protruding outwardly from said surface beyond said bottom and two sides.

10. The illuminated sign as set forth in claim 9, wherein said screen has a light-toned colour, and said indicia means are dark coloured, to provide a readily visible contrast under external illumination, for easy legibility.

11. The illuminated sign as set forth in claim 9, wherein said light sensor includes a photo cell incorporating a light-actuated switch that activates to an open circuit condition on exposure to ambient light of predetermined density.

12. A sign as claimed in claim 9 wherein said top defines a raised bridge portion, adjacent said display opening and projecting exteriorly beyond said screen and said single phosphorescent panel disposed below the top.

13. An illuminated sign as claimed in claim 12 wherein said light sensor is disposed within said raised bridge portion.

14. An illuminated sign as claimed in claim 13 wherein said raised bridge portion includes a recess for receiving said electrical circuitry.

15. A method of Illuminating identification indicia disposed in front of a single phosphorescent panel defining a screen having a protective ultraviolet filter layer, comprising:

(a) powering at all times said single phosphorescent panel with electrical power means at a level below the rated power level of the phosphorescent panel to visually illuminate said screen and prolong the longevity of said single phosphorescent panel;

(b) placing said ultraviolet filter layer on said screen to prolong the longevity of said single phosphorescent panel;

(c) activating said electrical power means below a selected level of light condition so as to visually view said identification indicia and deactivate said electrical power means above said selected level of light condition with switching means so as to prolong the longevity of said single phosphorescent panel.

16. A method as claimed in claim 15 wherein said switching means is placed remote from said phosphorescent panel.

17. A method as claimed in claim 15 wherein said single phosphorescent panel is disposed in a housing, said housing including a top, bottom and two spaced sides, said top defining a raised bridge portion projecting exteriorly beyond said bottom and two sides, said switching means disposed in the top.

* * * * *